US006698548B1

(12) United States Patent
Verrill

(10) Patent No.: US 6,698,548 B1
(45) Date of Patent: Mar. 2, 2004

(54) LADDER PLATFORM

(76) Inventor: Ernest C. Verrill, 2011 Highway 17N, #2300P, Mt. Pleasant, SC (US) 29466

( * ) Notice: Subject to any disclaimer, the term of this patent is extended or adjusted under 35 U.S.C. 154(b) by 0 days.

(21) Appl. No.: 10/342,022

(22) Filed: Jan. 14, 2003

Related U.S. Application Data

(60) Provisional application No. 60/352,645, filed on Jan. 29, 2002.

(51) Int. Cl.[7] ..... E06C 7/14
(52) U.S. Cl. ..... 182/129; 248/238
(58) Field of Search ..... 182/129; 248/238, 248/210

(56) References Cited

U.S. PATENT DOCUMENTS 4,261,435 A 4/1981 Winter
4,310,134 A * 1/1982 Schopp et al. ..... 248/210
4,874,147 A * 10/1989 Ory et al. ..... 248/210
5,333,823 A 8/1994 Joseph
5,511,753 A * 4/1996 Lage ..... 248/238
5,641,142 A 6/1997 Hanson et al.
5,782,314 A 7/1998 Zeitler
5,913,380 A 6/1999 Gugel et al.
5,941,344 A 8/1999 Spadaro
5,950,972 A 9/1999 Irish
5,967,259 A 10/1999 Williams
6,000,497 A 12/1999 Kain et al.

* cited by examiner

*Primary Examiner*—Alvin Chin-Shue
(74) *Attorney, Agent, or Firm*—Nelson Mullins Riley & Scarborough, L.L.P.

(57) ABSTRACT

A platform that attaches to a step on a ladder and has a tray that holds tools, work pieces or other articles. The tray attaches to the step using a support member and a latch, such as a spring-loaded latch. The platform can be removed from the step by moving the latch to its open position. The distance between the support member and latch can be adjusted to support various sizes of ladder steps. The platform can also be used while the ladder is supported against a wall.

15 Claims, 3 Drawing Sheets

LADDER PLATFORM

PRIORITY CLAIM

This application claims priority to Provisional Application Serial No. 60/352,645, filed Jan. 29, 2002, which is hereby incorporated by reference.

BACKGROUND OF THE INVENTION

The present invention relates generally to the art of article holding platforms that attach to ladders.

Ladders allow users to perform tasks in an elevated position. In order to reduce trips up and down the ladder for fetching tools, the user often times performs the balancing act of holding tools at the top of the ladder while also performing the intended task. Moreover, some tasks require more tools than can be held at the top of a ladder.

While there have been attempts to attach various devices that provide additional workspace to the top of ladders, a further need exists for a novel ladder platform.

SUMMARY OF THE INVENTION

The present invention recognizes and addresses various drawbacks of prior art constructions and methods. Accordingly, it is an object of the present invention to provide an improved ladder platform having means for rapid attachment and removal.

The present invention provides a platform that attaches to a step on a ladder and has a tray that holds tools, work pieces or other articles. The tray attaches to the step using a support member and a latch, such as a spring-loaded latch. The platform can be removed from the step by moving the latch to its open position. The distance between the support member and latch can be adjusted to support various sizes of ladder steps. The platform can also be used while the ladder is supported against a wall.

Other objects, features and aspects of the present invention are achieved by various combinations and subcombinations of the disclosed elements, which are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying drawings, in which.

Figure 1:
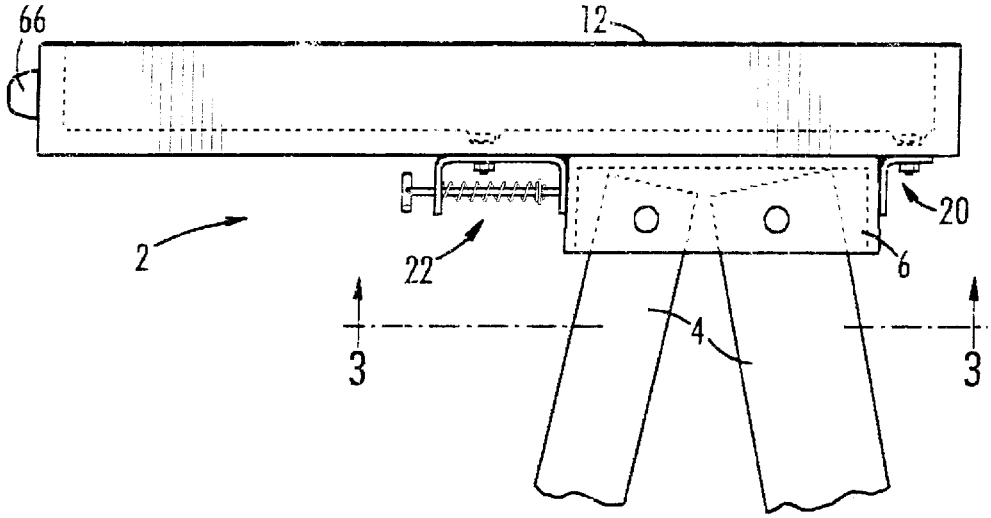
FIG. 1 is a side view of the platform attached to a ladder according to an embodiment of the present invention.

Repeat use of reference characters in the present specification and drawings is intended to represent same or analogous features or elements of the invention.

DETAILED DESCRIPTION OF PREFERRED EMBODIMENTS

Reference is made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can by made in the present invention without departing from the scope or spirit thereof. For example, features illustrated or described as part of one embodiment may be used on another embodiment to yield a still further embodiment.

Figure 2:
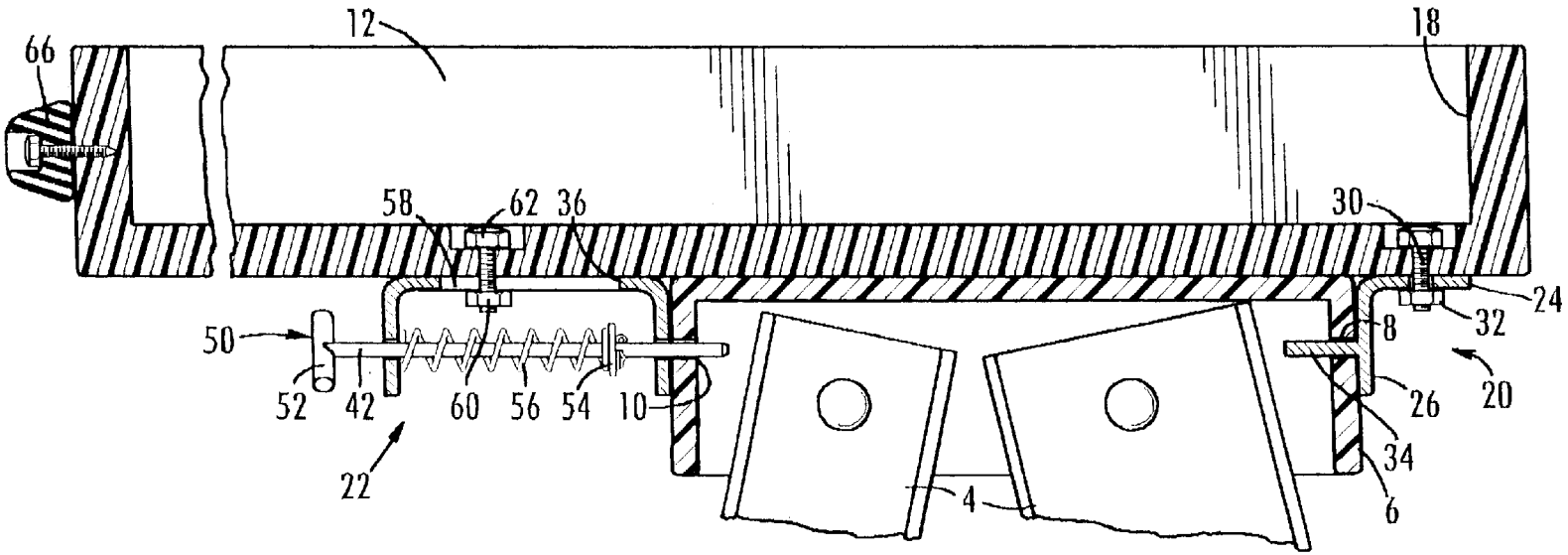
FIG. 2 is a side cross-sectional view of the platform attached to a ladder along line 2—2 of FIG. 3.

Referring to FIGS. 1 and 2, the present invention provides a platform 2 that attaches to a ladder 4. A ladder is a structure, often portable, for climbing up and down. There are many types of ladders available, each designed for a specific purpose. A straight ladder has two parallel sides joined by a series of steps that serve as footrests. In use, a straight ladder is supported by a wall or other structure. A step ladder generally has an A-frame shape with a ladder structure hinged to a support structure. While platform 2 has been described below with respect to a step ladder, platform 2 could be adapted to be attached to other types of ladders, including a straight ladder.

In one embodiment, the step 6 to which platform 2 will be attached has a pair of opposing holes 8 and 10 (shown in FIG. 2) to accommodate the attachment mechanism of platform 2. The ladder may be manufactured with these holes to accommodate platform 2. Alternatively, the user may form holes in the ladder step 6 to accommodate platform 2.

Platform 2 has a tray 12 that rests on top of the step 6 to provide an area for storing tools, work pieces or other articles. Tray 12 may be formed in various shapes to accommodate specific tools or other articles. Tray 12 may also have a ledge 18 (shown in FIG. 2) around its periphery that deters articles from falling off. In this embodiment, tray 12 is secured to the ladder 4 using a support member 20 and a latch 22.

Figure 3:
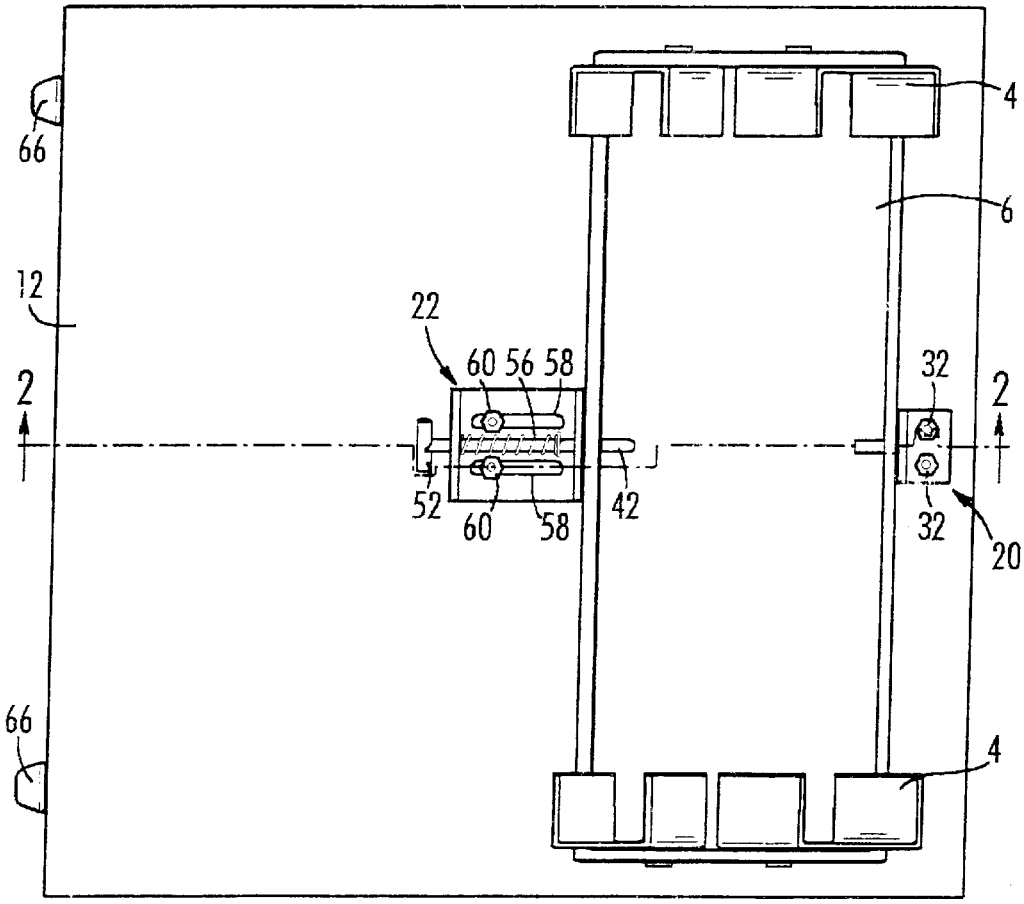
FIG. 3 is a bottom view of the platform along line 3—3 of FIG. 1.
Figure 5:
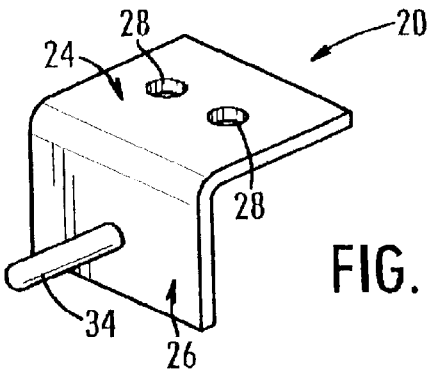
FIG. 5 is a perspective view of a preferred support member according to an embodiment of the present invention.

Referring to FIGS. 2, 3, and 5, support member 20 has a base portion 24 and an attachment portion 26. Base portion 24 fastens to the bottom of tray 12. In one embodiment, base portion 24 has holes 28 that receive bolts 30 therethrough. Nuts 32 have internal threads that mate with the external threads of bolts 30 to fasten base portion 24 to the bottom of tray 12. As one skilled in the art will recognize, base portion 24 may also be fastened to the bottom of tray 12 using screws, nails, adhesive or other fastening objects. Also, base portion 24 may be integrally formed in the bottom of tray.

Attachment portion 26 of support member 20 is approximately perpendicular to base portion 24 and carries a pin 34. Pin 34 is dimensioned and configured to be received by a hole 8 in the step 6 of the ladder 4. Hole 8 has a sufficient diameter for pin 34 to freely move therein. Support member 20 may also be attached to the step using other detachable fasteners.

Figure 4:
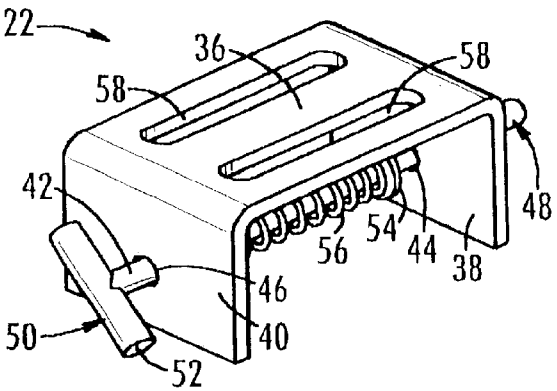
FIG. 4 is a perspective view of a preferred latch assembly according to an embodiment of the present invention.

Referring to FIGS. 2, 3 and 4, latch 22 has a base portion 36 that attaches to the bottom of tray 12. On opposing ends and approximately perpendicular to base portion 36, latch 22 has a front member 38 and a rear member 40. A latch bolt 42 is slidably received by a hole 44 and 46 in both front member 38 and rear member 40. Latch bolt 42 has a front end 48 that may be received by a hole 10 in the step 6 of the ladder 4. Rear end 50 of latch bolt 42 has a handle 52 that may be gripped by the user to move latch bolt 42.

Latch bolt 42 may move between a closed position in which the front end 48 is received by the step hole 10 and an open position where the front end 48 of latch bolt 42 is not received by the step hole 10. In the closed position, latch bolt 42 creates an interference that prevents removal of platform 2 from ladder 4. In the open position, however, platform 2 may be removed from the ladder 4. Latch bolt 42 preferably has a washer or flange 54 thereon that retains a spring 56. Spring 56 urges latch bolt 42 into the closed position.

Referring to FIG. 3, the position of latch 22 may be adjusted to accommodate various sizes of ladder steps. Slots 58 contained in base portion 36 allow positional adjustment of latch 22. To move latch 22 to a desired position, the user would untighten nuts 60 from bolts 62 sufficiently to allow movement of latch 22 along slots 58. Once latch 22 has been moved to the desired location, with front member 38 of latch 22 adjacent to step 6, the user would retighten nuts 60 to secure latch 22 in place. It should be clear to one of ordinary skill in the art that other detachable fasteners could be substituted for the embodiment described above.

Figure 6:
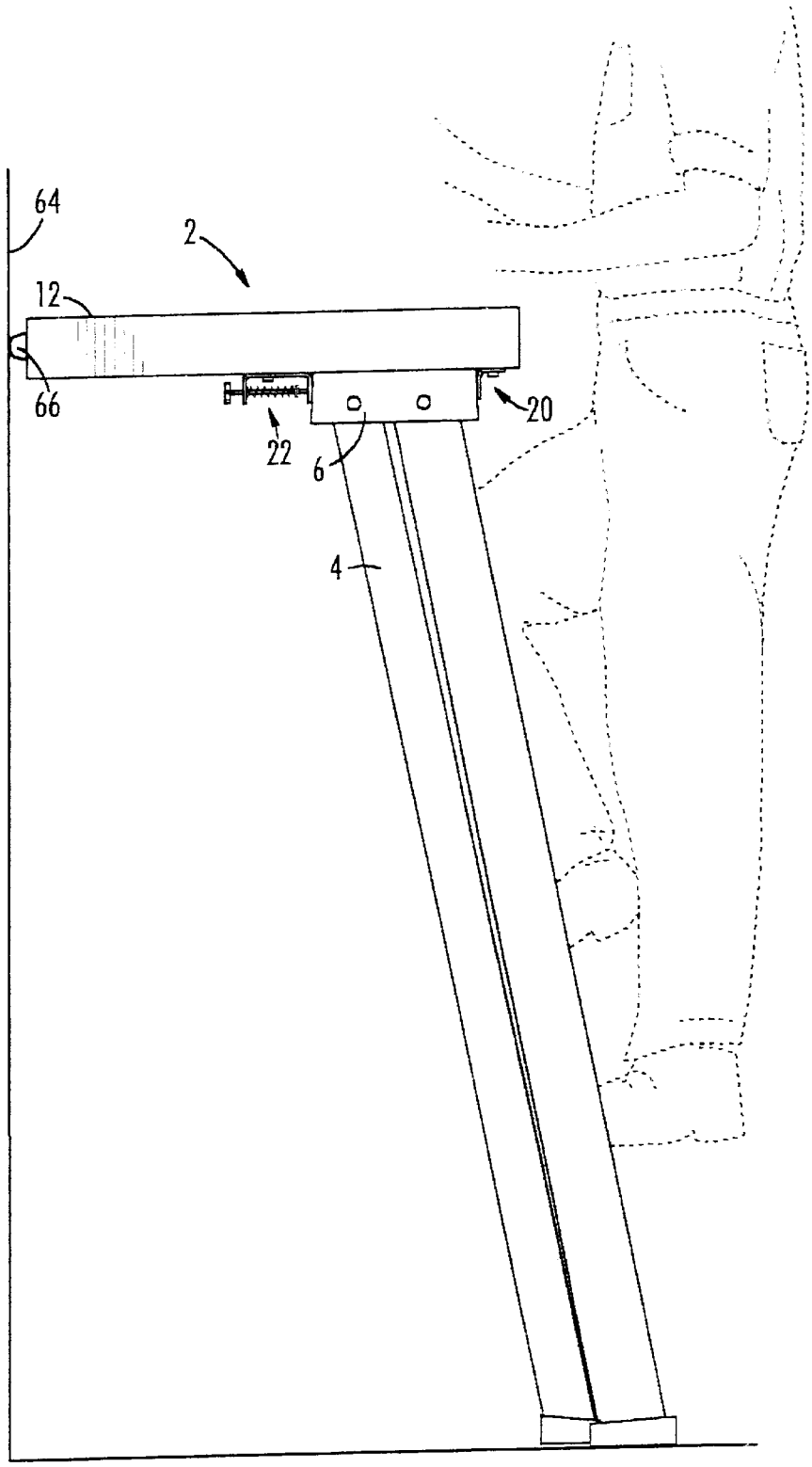
FIG. 6 is a side view of the platform attached to a ladder and supported against a wall.

Referring to FIG. 6, platform 2 may be used with a ladder 4 supported against a wall 64. Bumpers 66 or other suitable means may be used to prevent scratches on the wall. Bumpers 66 may be formed from rubber, fabric or other materials that would not likely scratch a wall 64.

In operation, the user would attach platform 2 by inserting pin 34 of support member 20 into a step hole 8. With latch bolt 42 moved to its open position, the user will then align front end 48 of latch bolt 42 with the step hole 10. Latch bolt 42 may then be moved to its closed position to fasten platform 2 in place. To remove platform 2, the user would reverse the steps for attaching platform 2.

It can thus be seen that the present invention provides a ladder platform having novel properties. While preferred embodiments of the invention have been shown and described, modifications and variations may be made thereto by those of ordinary skill in the art without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to be limitative of the invention.

What is claimed is:

1. A platform for a ladder having a step with a hole on a first side of the step, said platform comprising:

a tray;

a latch mechanism attached to said tray, said latch mechanism having a latch bolt movable between a closed position where said latch bolt is received by the hole in the step and an open position where said latch bolt is not received by the hole;

a support member being spaced apart from said latch mechanism and attached to said tray, said support member capable of engaging the step on a second side opposite the hole, wherein said second side has a hole opposite the first side and said support member has a pin portion received by the hole in the second side of the the step.

2. The platform as recited in claim 1, wherein said latch bolt is urged to said closed position.

3. The platform as recited in claim 1, wherein said support member has a base portion attached to said tray and an attachment portion extending approximately perpendicular from said base portion, said pin portion extending from said attachment portion.

4. The platform as recited in claim 3, wherein said attachment portion is adjacent to the second side of the step.

5. The platform as recited in claim 1, wherein said latch mechanism includes:

a base attached to said tray, said base having a first end adjacent the first side of the step and a second end opposite said first end;

a first member extending approximately perpendicularly from said first end of said base;

a second member extending approximately perpendicularly from said second end of said base; and wherein said first member and said second member have holes dimensioned to allow said latch bolt to pass therethrough.

6. The platform as recited in claim 5, wherein said latch bolt has a handle proximate to said second member that may be gripped by the user to move said latch bolt.

7. The platform as recited in claim 1, wherein the spacing between said latch mechanism and said support mechanism may be adjusted.

8. The platform as recited in claim 7, wherein said latch mechanism has at least one slot that allows positional adjustment of said latch mechanism.

9. A ladder comprising:

an elongated first rail;

an elongated second rail;

a plurality of approximately parallel steps disposed between said first rail and said second rail, at least one step of said plurality of steps having a hole;

a tray detachably attached to said at least one step;

a latch mechanism attached to said tray and having a latch bolt, said latch bolt movable between a closed position in which said latch bolt is received by said hole and an open position in which said latch bolt is not received by said hole;

a support member attached to said tray, said support member engaging said at least one step on a side opposite said hole, wherein said at least on step has a second hole on the side engaged by said support member and said support member has a pin portion recieved by said second hole.

10. The ladder as recited in claim 9, wherein said latch bolt is urged to said closed position.

11. The ladder as recited in claim 9, wherein said support member has a base portion attached to said tray and an attachment portion extending approximately perpendicular from said base portion, said pin portion extending from said attachment portion.

12. The ladder as recited in claim 9, wherein said latch mechanism includes:

a base attached to said tray, said base having a first end adjacent said hole and a second end opposite said first end;

a first member extending approximately perpendicularly from said first end of said base;

a second member extending approximately perpendicularly from said second end of said base; and wherein said first member and said second member have holes dimensioned to allow said latch bolt to pass therethrough.

13. The ladder as recited in claim 12, wherein said latch bolt has a handle proximate to said second member that may be gripped by the user to move said latch bolt.

14. The ladder as recited in claim 9, wherein the spacing between said latch mechanism and said support mechanism may be adjusted.

15. The ladder as recited in claim 14, wherein said latch mechanism has at least one slot that allows positional adjustment of said latch mechanism.

* * * * *